United States Patent [19]

Richter et al.

[11] 4,037,437

[45] July 26, 1977

[54] MACHINE FOR THE PROCESSING OF HIDES AND SKINS

[75] Inventors: Gerhard Richter; Peter Pöppel, both of Regensburg, Germany

[73] Assignee: USM Corporation, Boston, Mass.

[21] Appl. No.: 690,053

[22] Filed: May 26, 1976

[30] Foreign Application Priority Data

May 28, 1975 Germany ..... 2523555

[51] Int. Cl.[2] ..... C14B 1/06

[52] U.S. Cl. ..... 69/42

[58] Field of Search ..... 69/42, 1

[56] References Cited

U.S. PATENT DOCUMENTS

| | | | |
|---|---|---|---|
| 1,869,472 | 8/1932 | Freudenberg | 69/42 |
| 2,433,352 | 12/1947 | Edgar | 69/42 |
| 2,704,932 | 3/1955 | McIlvin et al. | 69/1 |
| 3,024,639 | 3/1962 | Lewis | 69/42 |
| 3,552,157 | 1/1971 | Repetto | 69/42 |
| 3,636,737 | 1/1972 | Schwaller et al. | 69/42 |
| 3,879,967 | 4/1975 | Repetto | 69/42 |

FOREIGN PATENT DOCUMENTS

| | | | |
|---|---|---|---|
| 1,308,609 | 10/1962 | France | 69/42 |
| 1,280,606 | 11/1961 | France | 69/42 |

*Primary Examiner*—Alfred R. Guest

*Attorney, Agent, or Firm*—Donald N. Halgren; Richard B. Megley; Vincent A. White

[57] ABSTRACT

A machine for the continuous processing of hides and skins comprising a first and a second processing unit mounted on a frame. The first unit includes rollers, a hide gripping arrangement, and means for driving same; the second unit being similarly equipped; the second unit being capable of processing that portion of the hide not processed by the first unit. The second unit grips the hide before processing by the first unit is commenced.

10 Claims, 6 Drawing Figures

MACHINE FOR THE PROCESSING OF HIDES AND SKINS

The invention is concerned with a machine for the continuous processing of hides and skins, comprising a processing unit having transport rollers which feed the hides and skins requiring processing through the machine, for example de-fleshing machines.

Hitherto known de-fleshing machines consist of a movable and a stationary part. The movable part comprises on the one hand a rubber roller and also a counter-pressure roller, and the stationary part two transport rollers and a rotatable de-fleshing cylinder. The counter-pressure roller presses the hide against the de-fleshing cylinder, the rubber roller presses the hide against the transport rollers in order to ensure a perfect transport of the hide through the machine, whereby the rubber roller likewise has the effect of a transport roller. With the machine in the open position the hide is lifted by two persons and inserted at working height in the machine or laid on the rubber roller and the counter pressure roller joining up with it below, inwards, in the machine (with the flesh side uppermost). The movable part of the machine is then moved with the hide lying on it towards the stationary part (closed position of the machine) so that the hide situated between them is firmly clamped with the rubber roller impinging upon the two transport rollers, and the counter-pressure roller impinging upon the de-fleshing cylinder. The hide is now drawn through the machine by rotation of the rubber and transport rollers and is processed by the rotating de-fleshing cylinder. As only the part of the hide inserted into the machine is processed on this passage, it is necessary for the complete de-fleshing of a hide to turn the hide when it comes out of the machine and to insert it again so that the remainder of the hide can be processed in the way mentioned. On such a machine it has proved especially disadvantageous that the inserting operation has to be carried out twice for each hide.

The arrangement of two identical de-fleshing machines nect to one another as processing units is known from U.K. Pat. specification No. 182993 into which when open a hide is inserted. The hide hangs with its one side into the first processing unit and extends with its other side over a transport roller of the second processing unit. It is held for the following processing operation by the first processing unit by the transport rollers arranged in this processing unit. The first processing unit processes firstly the one half of the hide, whereby the hide is simultaneously fed into the other (second) processing unit. By this type of hide insertion into the processing units there is always the danger that the insertion into the second processing unit will not be effected safely, since the hide can slip away downwards between the transport rollers of the processing units. The principle made known in the U.K. Pat. specification No. 182993 has not previously been able to be put into practice.

One of the various objects of this invention is to provide an improved through-feed machine for processing hides and skins.

With the above and other objects in view a machine for processing hides and skins is provided which comprises a frame and first and second processing units mounted in the frame, the first processing unit comprising a first processing member mounted for rotation in the frame, first roller means arranged in the frame to grip the hide or skin inserted in the machine, and means for rotating rollers of the first roller means to draw the hide or skin past the first processing member to process a first portion of the hide, and the second processing unit comprising a second processing member mounted for rotation in the frame, second roller means arranged in the frame to grip the hide or skin inserted in the machine not later than commencement of processing of the first portion of the hide by the first processing unit, and means for rotating rollers of the second roller means while the hide is gripped by the second roller means to draw the hide or skin past the second processing member to process the remainder of the hide not processed by the first processing unit.

By introduction of the hide into the second roller means so that it is gripped thereby before commencement of operation of the first processing unit it is ensured that the second roller means hold the hide firmly from beginning of processing.

There now follows a detailed description, to be read with reference to the accompanying drawings, of a through-feed machine for de-fleshing hides and skins which is illustrative of the invention. It will be realised that this machine has been selected for description by way of example and not by way of limitation of the invention.

In the accompanying drawings:

FIG. 1 is a representation of the two processing units when open, whereby the transport device has drawn the hide so far through that on its disengagement from the transport device its own gravity brings it around the rubber roller of the second processing unit and hence it cannot fall back again into the first unit.

FIG. 2 shows the closed first processing unit, and the closed rubber roller with transport roller of the second processing unit.

FIG. 3 is a representation corresponding to FIGS. 1 and 2, at the stage at which the hide has passed completely through the first processing unit, and the front end of the hide, not processed previously in the first processing unit, runs through in the second processing unit in the opposite direction and is taken up below by a conveyor belt.

Figure 5:
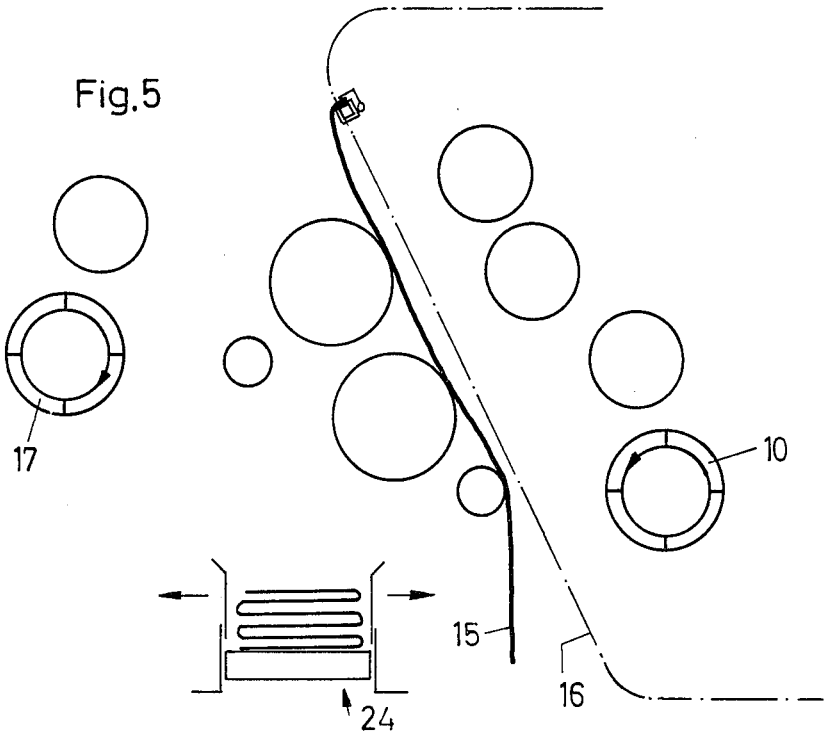
Figure 6:
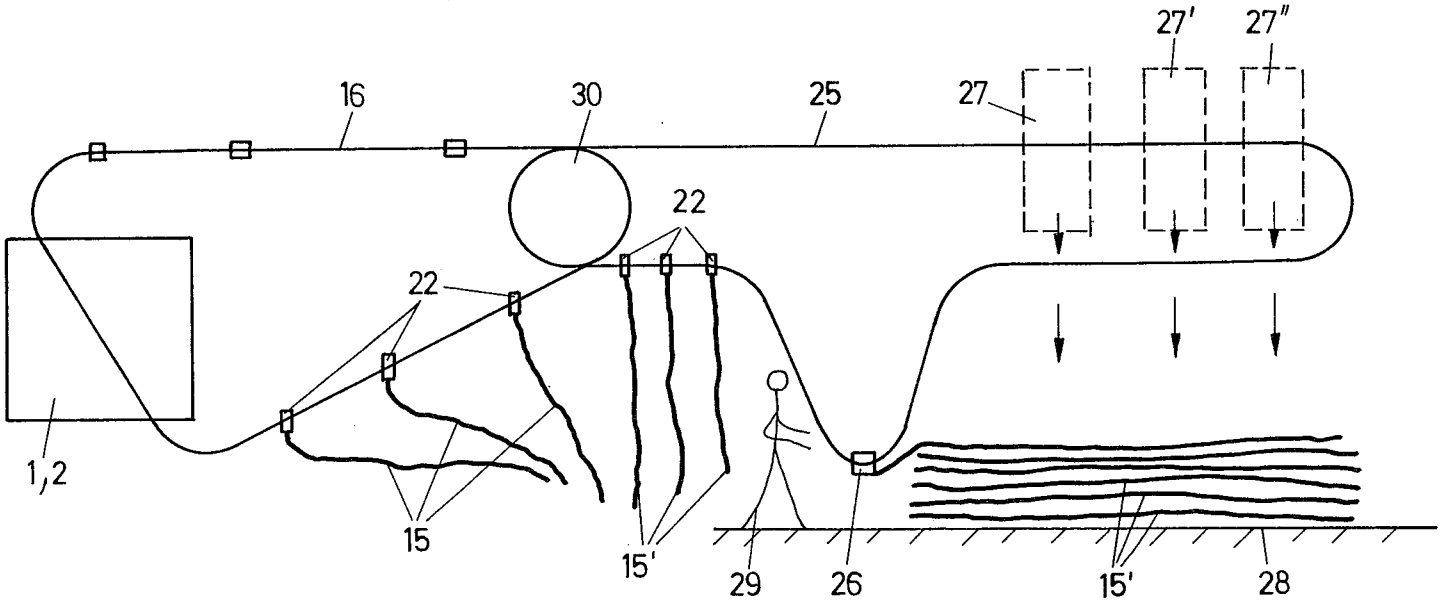

FIG. 5 is a representation in which the finished de-fleshed hide which is leaving the second processing unit is stacked in loops in a container, and FIG. 6 shows another embodiment of the device according to the invention, with a first transport device, a second transport device, by which the hides are taken directly from a preceding treatment device, e.g. a tanning vat, and from a transfer station.

The illustrative processing, or de-fleshing machine according to the invention consists of a first and second processing unit 1 and 2, means (not shown) for rotating rollers of the processing units, means (not shown) for moving rollers of the processing units between various positions, and a conveyor or transport device 16. The first processing unit 1 is composed of a first processing member or de-fleshing cylinder 10, and first roller means comprising an associated counter-pressure roller 11, a rubber roller 12 and transport rollers 13 and 14 working in combination with the rubber roller. In the second processing unit 2, which is constructed analogously to unit 1, a second processing member or de-fleshing cylinder 17, and second roller means comprising an associated counter-pressure roller 18, a rubber roller 19 and transport rollers 20,21 are provided.

The hide intended for processing is guided by means of the transport device 16 through the processing unit 1 and between the rubber roller 19 and the transport roller 20 of processing unit 2. The hides 15 are fastened to clamping devices 22 which can be automatically released.

Figure 1:
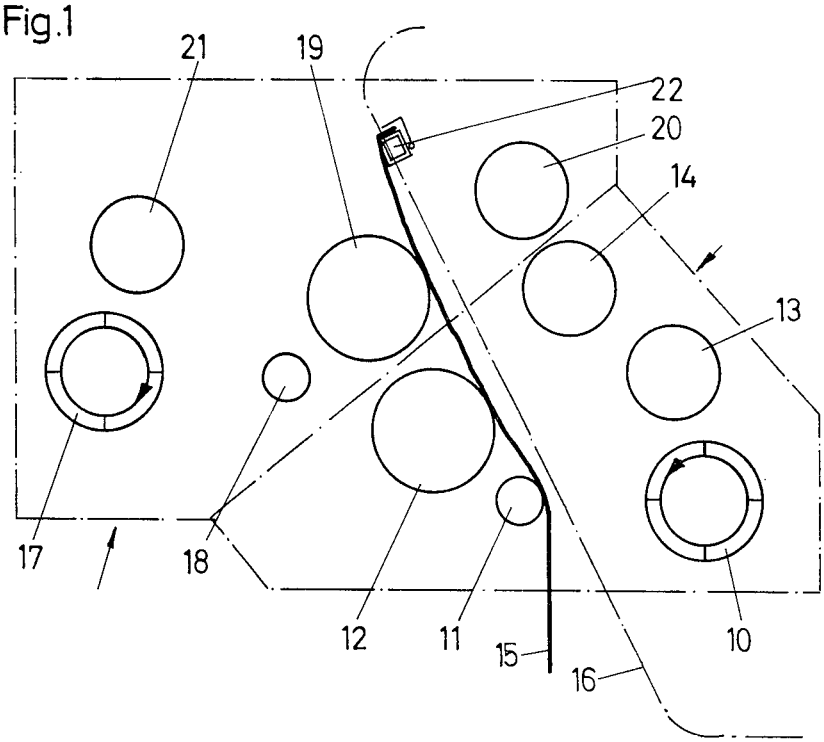
FIGS. 1 to 3 show various stages of the processing or of the operation of the machine according to the invention, as follows.
Figure 2:
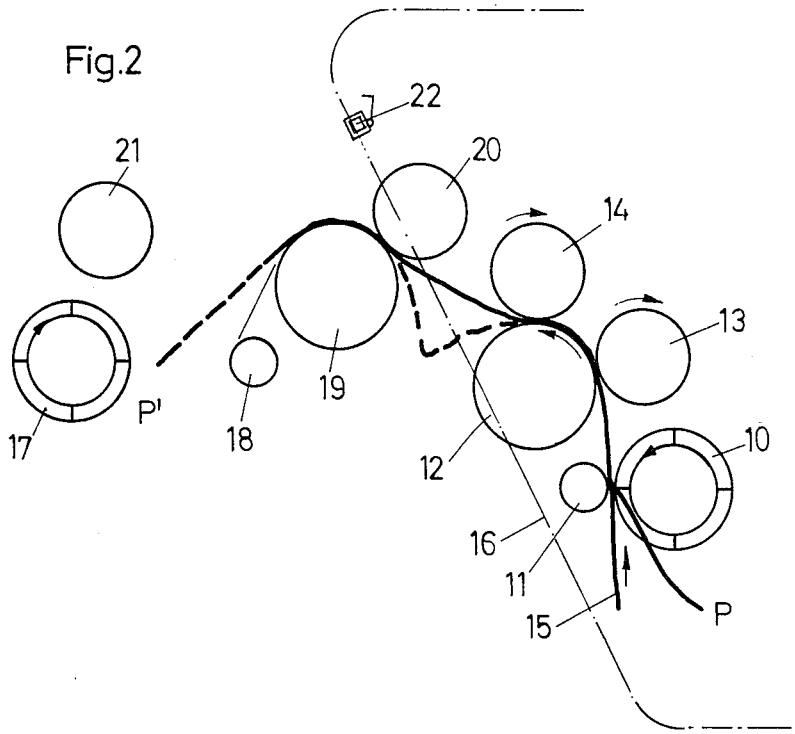

In FIG. 1 the de-fleshing machine according to the invention is represented in the open state, whereby the hide is introduced by the transport device 16 as far into the machine as is necessary for an unclamping from device 16. FIG. 2 shows the state of the de-fleshing machine when the processing unit 1 is closed, and in the closed position of the rubber roller 19 and of the transport roller 20 of unit 2, whereby the hide is unclamped and the leading end of the hide had laid itself over the rubber roller 19, forming a sag (shown in broken-line). This is only true if when processing by means of the first processing device 1 no pull is exerted on the hide 15 by the rollers 19 and 20 of the second processing unit 2. The directions of rotation of the individual rollers are shown by arrows, the de-fleshing cylinder 17, the counter-pressure roller 18 and the transport roller 21 are not in action.

Figure 3:
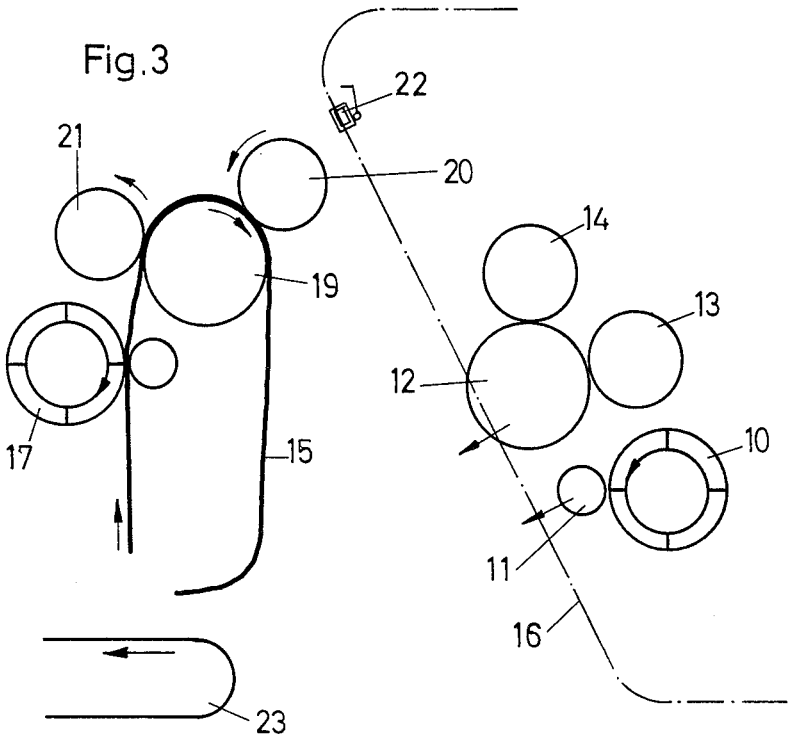

In FIG. 3 the stage in the processing is represented in which the hide has left the processing station 1 and is running through processing station 2 in the opposite direction (processing station 2 being here closed). The hide is here represented as being laid on a conveyor-belt 23 as it comes out of the machine.

It is necessary for the hide intended for processing to have run so far through processing station 2 in the entry-direction of the hide before the reversing of the drive, that the Point P — as shown in FIG. 2 — has assumed the approximate position of Point P', thereby ensuring that the hide has been completely de-fleshed in a defect-free way when it leaves the machine.

Figure 4:
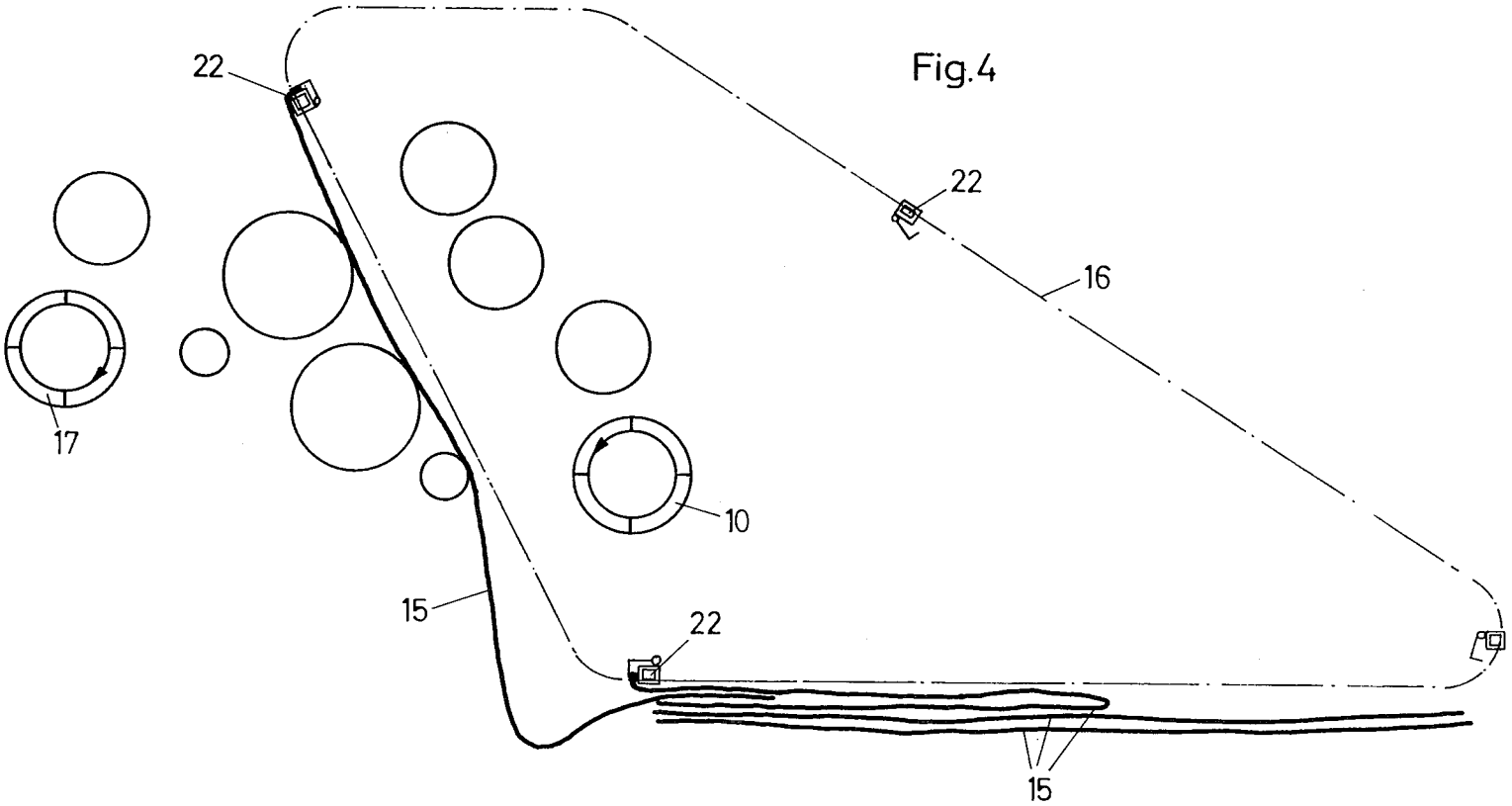
FIG. 4 shows an embodiment of the transport device in which the attaching of the hides to the clamping devices is represented.

FIG. 4 shows, with the machine in its open state, the transport device 16 with the clamping devices 22, and the way in which the prepared hides 15 are fixed into the clamping devices 16 at the bottom end of the machine and are drawn automatically through the machine.

Another way of removing the de-fleshed hide 15 is represented in FIG. 5. Here a chute-like device is provided at the bottom end of the machine, and actually at the site of issue of the hide 15, which is indicated diagrammatically by 24. The hide 15 is guided into this chute-like container so that it settles in folds. According to whether the folded hide is now to be drawn away to the left or to the right, it is transported away in the one case with the flesh-side uppermost and in the other case with the grain-side uppermost. For this transportation the chute-like device 24 is provided with a conveyor that is not shown in the drawing.

In another embodiment of the invention shown in FIG. 6, in which the processing machine 1,2 is indicated diagrammatically, a second transport device 25 with clamping devices 22 is combined with the transport device 16 with clamping devices 22. The transport device 25 is so laid out that it passes the treatment stations 27, 27', 27'', e.g. liming, bleaching, tanning vats, out of which the treated hides descend on to a work-table 28, which can, e.g. be also the floor, where they are stacked. An operator, indicated diagrammatically, 29 lifts the hides 15' on to the clamping devices 22 arranged one after the other, where the hides are fixed to the transport device 25 and transported further. At a transfer station 30, in itself known, the transfer of the hides 15' takes place, out of the transport device 25 into the transport device 16. The transfer device 30 can be specially designed as a store into which the hides 15' are fed at a greater speed by the transport device 25 than they are taken away by the transport device 16 (whereby the references 15 or 15' sometimes refer to the same hides). With this arrangement a collection of hides 15' at the work-table 28 can be clamped in rapid sequence by the operator 29 into the clamping devices 22, and either fed into the transfer-station 30, for recall, or taken over by the clamping devices 22 of the slower-running transport device 16, so that the transporting of the hides 15, 15' proceeds at the rate of the cycle, and with such an arrangement the presence of an operator at the processing machine itself is superfluous by reason of the mechanised feed.

By the acceptance of the hide right at the beginning of the processing it is ensured that the transport rollers of the second processing unit grip or hold the hide firmly from the beginning of the processing, so that its controlled feed to the de-fleshing cylinder of the second processing unit is ensured. The hide can then move as necessary between the transport rollers of the two processing units in the direction of transport, without there being any possibility of the hide slipping downwards. For the processing operation by the second processing unit the hide is presented in the right position, held by the transport rollers of the second processing unit. Thus it is possible that during processing by the first processing unit the transport rollers of the second processing unit only clamp the hide, without transporting it or without the transport rollers of the second processing unit already guiding the hide in this phase of processing to the processing station of the second processing unit.

In order to facilitate the initial insertion of the hide into the machine, the processing units are appropriately arranged side by side with upward running feed direction of the roller means, whereby the transport rollers of the processing units are situated in each case beyond the respective processing member, i.e. above the processing members. The transport rollers of the second processing device can be swivelled in such a way from the closed condition adjacent the second processing member to the region of the first processing unit, that the conveyor direction of the drive of the transport rollers of both processing units is essentially unidirectional.

The hide is appropriately inserted or drawn from below through the first processing unit right into the clamping area of the transport rollers of the second processing unit. By this means the hide is automatically presented correctly in a spread out condition.

In order to prevent the troublesome manual insertion which generally requires two or more operators, a circulating transport device passing through the machine is conveniently provided for the insertion of the hides, on which the hides to be processed are fastened and detached for execution of the processing and are transferable to the transport rollers.

Preferably the conveyor device runs from below into the machine and passes through the first processing unit and the transport rollers of the second processing unit.

In this way it is possible to process the hide in a single operation in passage, and to de-flesh it, with the result that the machine can be used in a continuous working plant.

In the preferred embodiment of the invention the conveyor device is a revolving chain with clamping devices, the loading site of which, or fastening site, is close to the hides ready for processing. The conveyor device is preferably so constructed that the hides requiring processing can be delivered to it from one or several preceding treatment stations.

The insertion of the hide requiring processing takes place from below into the first unit, with the help of the conveyor device; the hide is guided by the conveyor device through the first unit and by the rubber roller and the associated transport roller of the second unit. When the hide is inserted sufficiently the rubber roller and transport roller of the second unit are closed so that the hide is firmly clamped between them and its position cannot change. The hide is then automatically released from the conveyor device and the first unit is closed, whereby rubber roller and counter-pressure roller on one side of the hide come to rest against the associated transport rollers, and the processing cylinder on the opposite side of the hide. The hide is now processed by the processing cylinder, and continuously drawn by the transport rollers through the machine. There thus forms a slack or sag of the hide between the rubber rollers of the first and second unit, whereby the front end of the hide runs over the rubber roller of the second unit with the starting portion of the hide still not de-fleshed. When the hide has passed through the first processing station, the rubber roller and the transport roller of the second unit are set in rotation and the hide is lowered for a sufficient distance. The rubber roller and the transport roller with the hide come into contact with the transport roller and the processing cylinder as well as the counter-pressure roller. Shortly before closing the second unit the direction of drive for the rubber and transport roller of the second unit is reversed and the hide passes through the second processing unit in the opposite (upward) direction, whereby the part of the hide that has passed through the first processing unit as the leading-end which has not been processed, e.g. has not been de-fleshed, is now processed or e.g. de-fleshed. The finished processed hide passes downwards out of the machine automatically and is there removed.

Appropriately the upper transport rollers of the second unit can also be advanced whilst the hide passes through the first processing unit with the result that a sideways movement of the hide is impossible. By means of these two upper transport rollers the pull, which is exerted over the hide, is increased, so that every attempt at moving sideways is corrected. This sideways movement of the hide represents a problem with known machines, bringing with it considerable difficulties. In the case of the machine according to the invention the hide is fixed in every phase of its passage through the two processing units and is at no point in time left to itself, thus preventing a shifting or wandering of the hide. A machine of the type according to the invention is exceptionally safe to operate, because thanks to the automatic insertion of the hides into the processing machines by means of the conveyor device, accidents are almost completely excluded.

The removal of the hide takes place, for example, with the help of a conveyor belt which receives the hide in its full length and transports it away. It is, however, also possible to deliver the hide issuing from the second processing unit into a further treatment station.

On another embodiment of the invention, the removal of the hide when leaving the machine is carried out by its falling down into a chute-shaped container by means of conveyor, in which they are laid in loops or in folds. This has the advantage that they can be laid with either the flesh-side of the grain side uppermost, as desired (by the simple folding over of the uppermost fold, if necessary). On this embodiment a sideways delivery of the hide from the machine is possible, as is often appropriate for construction reasons.

With the processing machine according to the invention, the result is achieved that the hide is fed into the machine from below, and after processing can be delivered out of the machine downwards at the same place, thus being processed in continuous operation. In this way it is possible to incorporate the processing machine in a continuously operating plant.

On a special embodiment of the invention the conveyor device is a revolving chain with clamping yokes, providing a continuous run-through. The arrangement of the conveyor device can be such that a delivery of the hides can be effected from preceding treatment devices such as, e.g. from liming, softening or tanning vessels, so that one operator can without difficulty and rapidly connect a number of hides one after the other to the conveyor device and thus achieve a continuous feed for the continuous through-run. In addition, one can achieve a purely cycle-controlled processing plant without any operator on the processing machine.

Having thus described out invention, what we claim as new and desire to secure by Letters Patent of the United States is:

1. A machine for processing hides and skins comprising a frame and first and second processing units mounted in the frame, the first processing unit comprising a first processing member mounted for rotation in the frame, first roller means arranged in the frame to grip the hide or skin inserted in the machine, and means for rotating rollers of the first roller means to draw the hide or skin past the first processing member to process a first portion of the hide, and the second processing unit comprising a second processing member mounted for rotation in the frame, second roller means arranged in the frame to grip the hide or skin inserted in the machine not later than commencement of processing of the first portion of the hide by the first processing unit, and means for rotating rollers of the second roller means while the hide is gripped by the second roller means to draw the hide or skin past the second processing member to process the remainder of the hide not processed by the first processing unit, said machine also comprising a conveyor device by which the hides or skins are inserted upwardly, from below the first processing unit, into the first processing unit between rollers of the first roller means and between rollers of the second roller means.

2. A machine according to claim 1 wherein the first roller means comprises at least one transport roller mounted for rotation in the frame, and two rollers mounted for movement in the frame towards and away from the transport roller and the first processing member, a first of these rollers cooperating with said at least one transport roller to grip the hide or skin and a second of these rollers pressing the hide or skin against the first processing member.

3. A machine according to claim 2 wherein the second roller means comprises third and fourth rollers mounted for relative movement of approach to a closed condition to grip the hide or skin and apart to release the hide or skin, and for movement while in the closed condition to carry said remainder of the hide or skin into operative engagement with the second processing member.

4. A machine according to claim 3 comprising a fifth roller mounted for movement towards and away from the second processing member, the fifth roller pressing said remainder of the hide or skin against the second processing member during processing of the remainder of the hide or skin.

5. A machine according to claim 3 wherein the transport roller and the first roller of the first roller means are positioned above the first processing member and are rotated to draw the said first portion of the hide upwardly past the first processing member, and the third and fourth rollers are mounted above the second processing member and are rotated to draw said remainder of the hide or skin upwardly past the second processing member, during the processing operation.

6. A machine according to claim 1 wherein the conveyor device comprises a continuous chain having clamping devices thereon by which a hide is clamped and inserted by movement of the chains.

7. A machine according to claim 1 wherein the hides are delivered to the conveyor device from preceding treatment units.

8. A machine according to claim 8 comprising a further conveyor device by which the hides are carried from preceding treatment units and a transfer device by which hides are transferred from the further conveyor device to the first-mentioned conveyor device.

9. A machine according to claim 8 wherein the transfer device comprises storage means.

10. A machine according to claim 8 wherein the further conveyor device is faster than the first-mentioned conveyor device.

* * * * *

UNITED STATES PATENT OFFICE

CERTIFICATE OF CORRECTION

Patent No. 4,037,437 Dated July 26, 1977

Inventor(s) Gerhard Richter et al.

It is certified that error appears in the above-identified patent and that said Letters Patent are hereby corrected as shown below:

Column 8, claim 8, line 1, delete the number "8" and insert the number -- 7 --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*